US005499780A

United States Patent [19]

Gensheimer

[11] Patent Number: 5,499,780

[45] Date of Patent: Mar. 19, 1996

[54] ROLL BLADDER SUPPORT STRUCTURE

[75] Inventor: Robert P. Gensheimer, Sparta, N.J.

[73] Assignee: Convertech, Denville, N.J.

[21] Appl. No.: 300,730

[22] Filed: Sep. 2, 1994

[51] Int. Cl.[6] ..... B65H 75/24

[52] U.S. Cl. ..... 242/571.1

[58] Field of Search ..... 242/571.1, 571.2; 279/2.05, 2.06, 2.07, 2.08

[56] References Cited

U.S. PATENT DOCUMENTS

| | | | |
|---|---|---|---|
| 2,331,743 | 10/1943 | Sullivan . | |
| 3,029,037 | 4/1962 | Williams et al. | 242/571.1 |
| 3,032,288 | 5/1962 | Tidland | 242/571.1 |
| 3,048,345 | 8/1962 | Willard . | |
| 3,122,376 | 2/1964 | Atherholt, Sr. . | |
| 3,391,878 | 7/1968 | Naccara . | |
| 3,596,847 | 8/1971 | Peterson . | |
| 3,741,571 | 6/1973 | Prazak | 242/571.1 |
| 3,762,730 | 10/1973 | Cameron . | |
| 3,863,857 | 2/1975 | Smith . | |
| 3,908,926 | 9/1975 | Ochs et al. . | |
| 3,945,583 | 3/1976 | Ochs et al. | 242/571.1 |
| 4,030,415 | 6/1977 | Fellows . | |
| 4,114,909 | 9/1978 | Taitel et al. . | |
| 4,135,677 | 1/1979 | Warczak | 242/571.1 |
| 4,220,291 | 9/1980 | Papa . | |
| 4,229,014 | 10/1980 | Crowe . | |
| 4,461,430 | 7/1984 | Lever . | |
| 4,473,195 | 9/1994 | Marin . | |

*Primary Examiner*—John P. Darling
*Attorney, Agent, or Firm*—William Squire

[57] ABSTRACT

A removable bladder assembly for insertion into the core of a roll support sleeve having roll gripping lugs radially displaced by the bladder assembly includes an outer flexible bladder tube and an inner rigid tube for supporting the outer tube. A coupling member is secured to the tubes at each of the tube ends to seal and clamp the tubes together. The member includes a nut axially threaded to the inner tube bore and having an outwardly extending flange. A T-shaped cap has a section over the outer tube and a section over the nut flange. The cap has a flange depending from between the sections and located between the nut flange and the ends of the two tubes. An O-ring and washer like ring are in a rigid tube recess between the rigid tube end and the cap flange. An annular wedge shaped recess is in the cap section overlying the outer tube radially aligned with the O-ring. Axially compression of the O-ring by the nut flange radially expands the O-ring deforming the outer tube into the recess to effect a clamping seal between the outer and inner tubes. A plug is secured in each end of the sleeve and include a pilot pin for receiving the nut bore. A journal extends from each plug beyond the sleeve.

26 Claims, 2 Drawing Sheets

ROLL BLADDER SUPPORT STRUCTURE

BACKGROUND OF THE INVENTION

This invention relates to expansible shafts and mandrels for supporting rolls and the like, and more particularly, to pneumatically operated expandable bladder shaft structures releasably secured to the core of a roll.

In expandable shafts for supporting rolls, a flexible tube is supported on a rigid tube within a rigid outer cylinder. Radially movable lugs are spaced about the cylinder in openings in the outer cylinder and are radially displaced by expansion of the flexible tube. Pressurized air is supplied to the core of the flexible tube through a journal to expand the tube to radially extend the lugs. The displaced lugs grip the core of a roll in which the expandable shaft is inserted. Such rolls may be large heavy rolls of paper or web material, for example. The shaft provides journals for rotating the supported roll in a process not related to the expandable shaft construction.

The inner rigid tube and outer flexible tube need to be fluid sealed to permit the flexible tube to be expanded in response to the pressurized air. These may form subassemblies which are located within the core of the outer rigid cylinder. U.S. Pat. Nos. 3,391,878; 3,048,345; 3,596,847; 2,331,743; 4,030,415; 4,229,014; 4,461,430; 4,473,195 and 3,908,926 illustrate prior art expansible mandrels or shafts for supporting rolls or the like.

An important criteria recognized by the present inventor is to provide a reliable seal between the inner and outer tubes within the outer cylinder so as to be responsive to pressurized air for expanding the flexible tube. A further criteria recognized is to provide easy access to the inner rigid and flexible tube subassembly for maintenance and repair or replacement as a unit while maintaining the sealed arrangement of the subassembly tubes. A further criteria recognized is to provide easy access to the subassembly while reliably sealing it to the outer cylinder.

In the '878 patent, the flexible tube is sealed by tooth like ridges. These might damage the flexible tube and sacrifice the integrity of the seal. Further, the subassembly is relatively difficult to remove from the outer cylinder because the subassembly is shown staked to one of the journals. Patents '926 and '345 show the flexible tube inserted in mating bores. The '345 patent further shows serrations on a conical plug to effect the sealing. This insertion of the flexible tube into a bore may affect the integrity of the sealing and also add difficulty to axial insertion and removal of the flexible tube due to the relatively high friction between the elements. Patent '743 uses a plurality of sealing membranes and plates which need to be separately assembled and disassembled. For a large number of such membranes this can be tedious. Others of the patents noted above do not address or recognize the problems identified.

SUMMARY OF THE INVENTION

The present inventor recognizes a need for a roll bladder support structure in which reliable sealing of the inner bladder assembly components is provided while permitting the inner assembly to be readily inserted and removed from the rigid outer cylinder. Further, the present inventor recognizes a need to simply seal the inner assembly to the outer cylinder while readily permitting the assembly to be so inserted and removed.

In a roll bladder support structure including a hollow core cylindrical sleeve extending along a longitudinal axis, the sleeve having opposing ends and a plurality of spaced openings therethrough in communication with the hollow core; a plurality of lugs, each in a different opening extending radially through the sleeve into the core and arranged for radial displacement in the corresponding opening, a bladder assembly for radially displacing the lugs according to the present invention comprises an inner rigid tube nested within and concentric with an outer flexible tube for supporting the outer tube, the outer tube for selectively engaging and radially outwardly displacing the lugs in response to a pressurized fluid applied to the core of the outer tube. First and second like coupling means are at a respective different end of the tubes for coupling and securing together the inner and outer tubes in fluid sealing engagement at each end to form a removable integral assembly relative to the cylinder, each coupling means having a circular cylindrical axially extending bore, the bores being coaxial, each coupling means including radially expandable means responsive to axial compression for sealing the inner tube to the outer tube and means for axially compressing the expandable means.

In a roll bladder support structure according to a further embodiment the structure including an outer sleeve and an inner bladder assembly comprising an inner rigid tube and an outer flexible tube resposive to pressurized air applied to the flexible tube core, a joint for sealing the inner rigid tube to the outer flexible tube comprising a rigid inner tube nested within a flexible outer tube and a coupling member secured to each of the ends of the nested tubes. The coupling member comprises a tubular member over the outer tube and having an annular recess theron overlying the outer tube; a flange depending from the tubular member; a flexible compressible and expandible ring between (1) the outer end of the inner tube and the flange and (2) between the outer end of the inner tube and the outer tube aligned radially with the annular recess; and means coupled to the inner tube for axially compressing the expandible ring to radially expand the ring against the outer tube to force the outer tube into the recess forming a seal therebetween.

A roll bladder support structure according to a further embodiment of the present invention comprises an expandable hollow core cylindrical bladder assembly secured in the sleeve core and has opposing ends, the assembly including an inner rigid tube and an outer concentric flexible tube concentric with the inner tube for selectively engaging and radially outwardly displacing the lugs in response to a pressurized fluid applied to the core of the outer tube. The assembly includes first and second like coupling means at a respective different assembly end for coupling and securing together the inner and outer tubes in fluid sealing engagement at each end to form a removable integral assembly relative to the cylinder, each coupling means having a circular cylindrical axially extending bore, the bores being coaxial. A bladder assembly support means is releasably secured to the sleeve in the core comprising a pair of opposing cylindrical bladder assembly support male members each closely and fluid sealingly received in a different bore extending axially toward one another for providing sole radial support for the assembly at the first and second coupling means, the support means including means at each assembly end for axially securing the assembly in the core.

In accordance with a further embodiment, sealing and clamp means are provided including axially and radially displaceable means at each of the inner and outer tube ends for radially clamping each of the ends of the inner and outer tubes together and for radially fluid sealing the inner tube to the outer tube at their ends in response to axial displacement of the axially displaceable means.

IN THE DRAWING

DESCRIPTION OF THE PREFERRED EMBODIMENT

Figure 1:
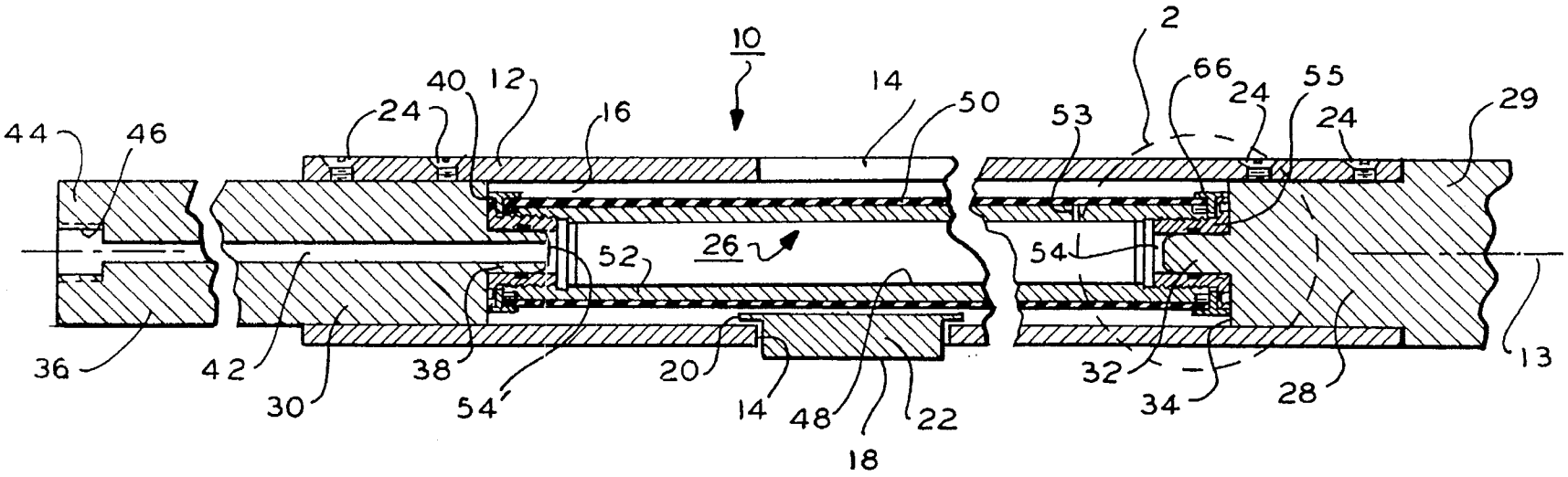
FIG. 1 is a side elevation sectional view of a roll expandable bladder support structure according to an embodiment of the present invention.

In FIG. 1, expandable bladder roll support structure 10 comprises an outer rigid preferably steel or aluminum circular cylinder 12 lying on longitudinal axis 13. The cylinder 12 has an outer diameter dimensioned to be received within the core of a roll (not shown) to be temporarily secured to the structure 10. A plurality of openings 14 axially and circumferentially spaced about the cylinder pass through the cylinder wall in communication with the cylinder core 16.

A like plurality of roll gripping lugs 18 (one being shown) are provided, each lug passing through and located in a corresponding opening 14. The lugs include an interior flange 20 located in the core 16 and a body portion 22 which passes radially through the opening 14. The lugs 18 are radially movable in openings 14 for gripping a roll core (not shown) in a known manner. The lugs 18 and openings 14 may be of conventional configuration.

A plurality of screws 24 are in the cylinder 12 at each end for securing removable bladder assembly 26 in the core 16 to the cylinder 12. The screws abut and secure plugs 28 and 30 each at a respective corresponding cylinder 12 end. Plug 28 is a circular steel cylinder closely received in the core 16 and extends cantilevered from a larger diameter circular cylindrical journal 29. Journal 29 is used to rotationally support a roll secured to structure 10 in a known manner. A circular cylindrical pilot pin male member 32 axially extends inwardly from plug 28 in core 16 coaxially on axis 13. The end of plug at the junction with member 32 is planar and forms a shoulder 34 lying in a plane normal to axis 13.

Plug 30 comprises a circular cylindrical steel shaft a portion of which is in core 16 and the remainder of which extends beyond cylinder 12 to form a roll support journal 36. A pilot pin male member 38 of like external dimension as the member 32 extends axially inwardly from the plug 30 toward member 32 and coaxial therewith. The junction of member 32 with plug 30 comprises a planar shoulder 40 parallel to shoulder 34. A conduit 42 is in the plug 30—journal 36 through member 38 in communication with the core 48 of bladder assembly 26. A fitment 46 is at the end 44 of journal 36 for receiving pressurized air from a source (not shown).

The bladder assembly 26 comprises an elastomeric flexible expandable circular cylindrical outer tube 50 forming an expandable bladder. A rigid preferably aluminum inner circular cylindrical bladder support tube 52 is nested in the core of tube 50 for supporting tube 50. An aperture 53 through the wall of inner support tube 52 couples the pressurized air applied to the core 48 to the core of outer flexible tube 50 to expand the outer tube 50.

The tubes 50 and 52 have the same axial length and are concentric with axis 13. An identical tube sealing and coupling assembly 54 and 54' is at each end of the nested tubes 50 and 52. Coupling assemblies 54 and 54' seal the tubes 50 and 52 to each other at their respective opposite ends. The assembly 54 is also movably sealed to the male member 32 and the assembly 54' is movably sealed to the male member 38 at the other end of the tubes 50 and 52. Since the assemblies 54 and 54' are the same in construction, the description of assembly 54 is representative.

Figure 2:
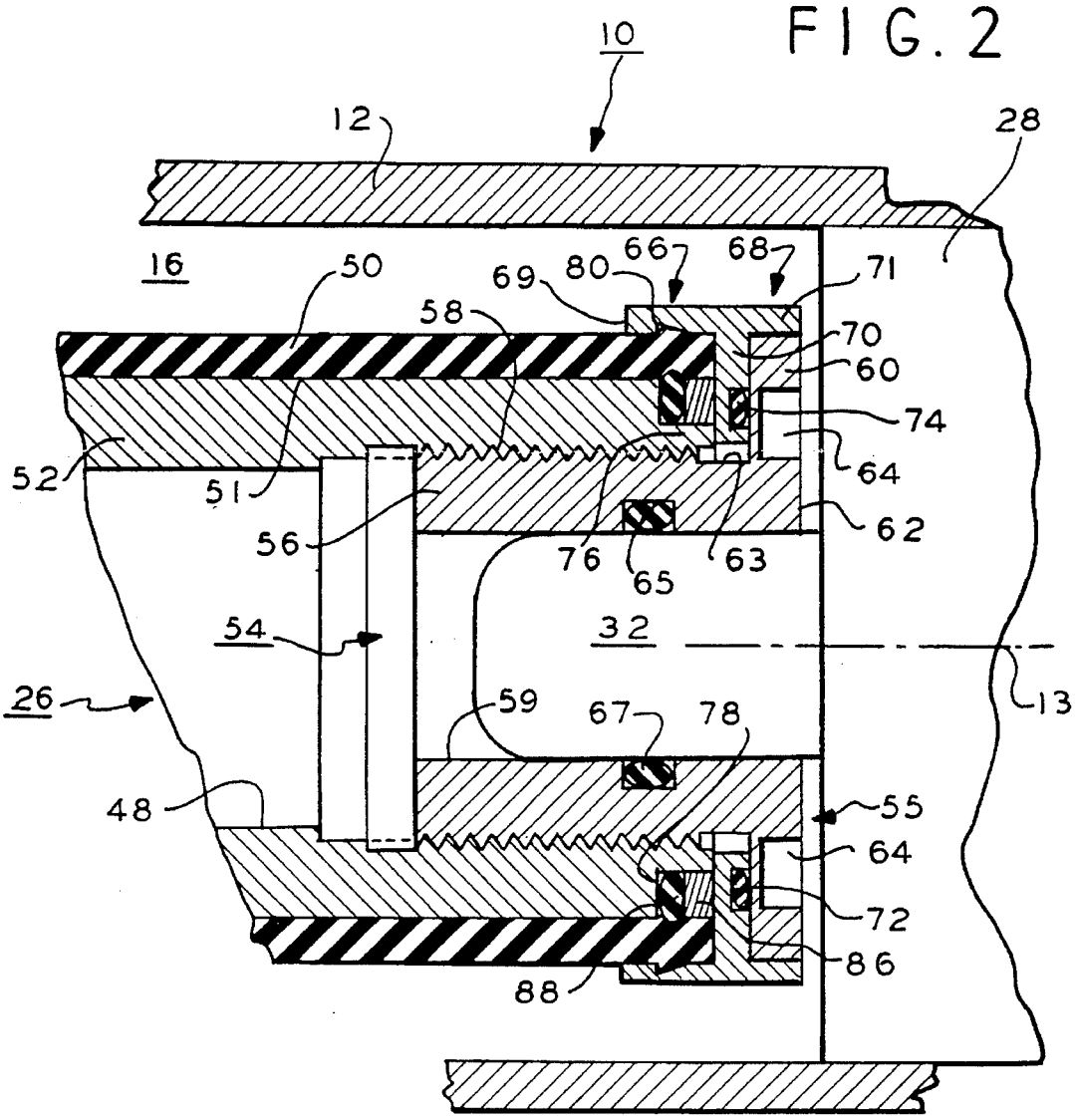
FIG. 2 is a more detailed view of a portion of the structure of FIG. 1 taken at the encircled region 2.

In FIG. 2, coupling assembly 54 includes a nut 55 comprising a circular cylindrical tubular member 56, preferable brass, having external axially extending threads 58 threaded to mating internal threads in the internal bore of inner tube 52. The threads 58 are concentric with axis 13. The member 56 has a bore 59. A planar washer-like flange 60 extends radially outwardly from member 56 at the member 56 outer end 62. An annular undercut 63 is between threads 58 and flange 60. An annular groove 65 is formed in the bore 59 surface of the tubular member 56. An O-ring 67 is in groove 65 to provide fluid sealing between the tubular member 56 and male member 32. The bore 59 has an internal diameter that is dimensioned to closely receive the male member 32. The O-ring 67 fluid seals the member 56 to the male member 52 at their interface as these members axially and rotationally move relative to each other.

A plurality of annularly spaced wrench receiving recesses 64 are in the side of flange 60. A spanner wrench (not shown) inserted in the recesses 64 is used to manually rotate the nut 55 about axis 13. This axially displaces the nut 55 along axis 13 in the core 48 of inner tube 52 to seal the tubes 50 and 52 to each other as described below.

A T-shaped cap 66 comprises a tubular portion 68 concentric with axis 13 and a planar flange 70 depending from portion 68. The portion 68 has an inner section 69 which overlies outer tube 50 and an outer section 71 which overlies flange 60. The flange 70 major surface is coextensive with a major portion of flange 60 major surface in the direction along axis 13. An annular groove 72 is in the surface of flange 70 facing flange 60. An O-ring 74 is in groove 70 to provide fluid sealing between flanges 60 and 70.

Figure 3:
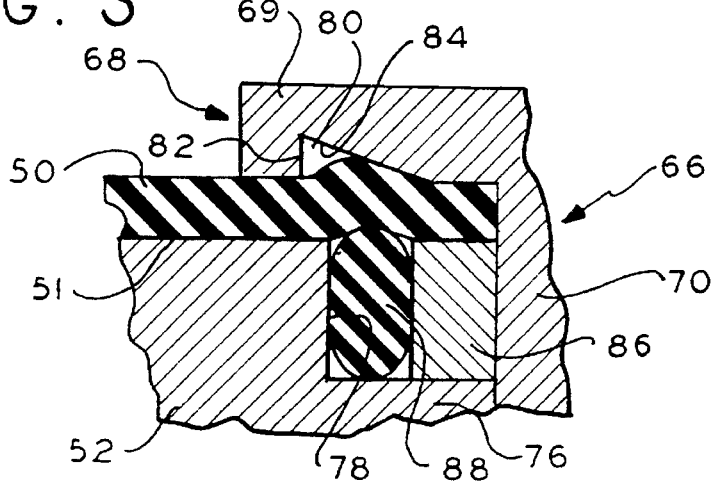
FIG. 3 is a more detailed view of a portion of the structure of FIG. 2 illustrating a preferred sealing arrangement between the expandable bladder and the rigid inner bladder support tube and a coupling arrangement for the two tubes.

In FIG. 3, an annular recess 80 is formed in the surface of tubular member 68 section 69 facing the outer surface of outer tube 50. The recess 80 has a first wall 82 which extends radially normal to axis 13. This wall is distal flange 70 in an axially inward direction of the tube 50. The recess 80 has a second wall 84 which forms the base of the recess and is inclined relative to the axis 13 and the outer facing surface of outer tube 50. Wall 84 lies on a conical surface of revolution whose apex intersects axis 13 beyond the ends of the tubes 50 and 52. The inclination of wall 84 is preferably about 30° relative to axis 13 and the outer surface of tube 50. This angle is not critical. Wall 84 intersects the inner surface of tubular member 68 to form a wedge shaped recess 80. While the recess 80 is shown angular, it may also be curved in an arc for the purpose to be described. It should not be rectangular or square in transverse section for that purpose.

The end 76 of inner rigid tube 52 is formed with an annular step 78 formed by normal surfaces respectively parallel to flange 70 and to axis 13. Step 78, FIG. 2, is in communication with flange 70 and with the inner surface 51 of outer tube 50. The remaining portion of end 76 abuts the innermost portion of flange 70 next adjacent to the tubular member 56. The member 56 has an annular groove 63 between threads 58 and flange 60. A portion of end 76 and the inner edge of flange 70 of cap 66 overlie groove 63 in spaced relation.

In FIG. 3, a washer-like ring 86 is in step 78 between the inner surface 51 of tube 50 and end 76 of inner tube 52. The ring 86 also abuts the facing surface of flange 70. An O-ring 88 is in step 78 between ring 86, tube 52 and tube 50 surface 51, abutting surface 51.

To assemble the bladder assembly 26, FIG. 2, the inner tube 52 is slid into the core of the outer tube 50 for supporting the outer tube. Coupling assemblies 54 and 54' are then assembled to the respective ends of the tubes. The O-ring 88 and ring 86 are placed in step 78 of the tube 52 at each end. The cap 66 section 69 is placed overlying the tube 50 end with the flange 70 abutting the ends of the two tubes. This captures the O-ring 88 and ring 86 between the flange 70 and the tubes 50 and 52. The O-ring at this time is aligned radially with recess 80, FIG. 3. The nut 55 is then threaded to the threaded bore of inner tube 52 with the O-ring 74 between the flanges 60 and 70.

A spanner wrench is inserted in recesses 64 and the nut 55 is rotated to axially displace the nut flange 60 along axis 13 against the cap 66 flange 70. Further rotation of the nut 55 forces ring 86 against the O-ring 88 in step 78 compressing this O-ring. This compression is such that the O-ring 88 deforms into an oval cross section with the long axis of the oval normal to axis 13 and the abutting inner surface 51 of tube 50. This elongates the O-ring forcing it against the surface 51 of tube 50.

The O-ring 88, is radially aligned with recess 80 in cap 66, FIG. 3. The O-ring 88 expands out of step 78 against the outer tube 50. This forces the outer tube 50 to radially deform and enter into the recess 80 of cap 66. The inclined wall 84 and axial extent of the wedge shape of the recess 80 facilitates the tube 50 portion overlying the recess entering into the recess 80.

It is believed that a square or rectangular recess will not work as well. The gradual slope of the relatively broad surface of the wall 84 provides good sealing action with the tube 50. Further axial compression of the O-ring 88 thus provides enhanced radial sealing action with the tube 50. This radial compression of the O-ring 88 against the tube 50 also provides a clamping action therebetween. Thus, axial displacement of the nut 55 provides increased axial compression of O-ring 88 and increased sealing and clamping forces.

The O-ring 88 seals its interface with the tube 52 in step 78. Thus, the interface between the tubes 50 and 52 is sealed by O-ring 88. The interface between tube 52 and nut 55 is sealed from the ambient by O-ring 74 and by the engagement of the tube 50 in recess 80. Thus all relevant interfaces for the cores of the tubes 50 and 52 are sealed from the external ambient environment. In this way, both ends of the tubes 50 and 52 are clamped and sealed by the coupling assemblies 54 and 54' to form bladder assembly 26.

The bladder assembly 26 including tubes 50 and 52 and the coupling assemblies 54 and 54' at each end of the tubes is removable from and insertable into the core 16 of the sleeve 12 as a unit. To assemble the structure 10, plug 30 is secured to sleeve 12 in core 16 by screws 24. This locates male member 32 in the core 16 which serves as a pilot pin for the bladder assembly 26 to be assembled thereto. The bladder assembly 26 is then inserted into core 16 so that the bore 59 of the nut 55 of coupling assembly 54' is mounted onto the male member 38. The male member 32 of plug 28 is then inserted into core 16 and into the bore 59 of assembly 54 as shown in FIG. 1. The screws 24 then lock the plug 28 in place. The shoulders 34 and 40 axially lock the respective coupling assemblies 54 and 54' in position via nuts 55 and caps 66, FIG. 1.

With the structure 10 so assembled, the structure 10 is then placed in a core of a roll (not shown). Pressurized air applied to fitment 46 expands the outer flexible tube 50 in a radial direction radially displacing the lugs 18 (one being shown in FIG. 1) to releasably grip the roll core.

While a particular embodiment has been illustrated, it will occur to one of ordinary skill that various modifications may be made to the disclosed embodiment. It is intended that the disclosed embodiment is given by way of illustration and not limitation. The scope of the invention is as defined in the appended claims.

What is claimed is:

1. A roll bladder support structure comprising:

a hollow core cylindrical sleeve extending along a longitudinal axis, said sleeve having opposing ends and a plurality of spaced openings therethrough in communication with the hollow core;

a plurality of lugs, each in a different opening extending radially through the sleeve into the core and arranged for radial displacement in the corresponding opening;

an expandable hollow core cylindrical bladder assembly secured in the sleeve core and having opposing ends, the assembly including an inner rigid tube and an outer flexible tube having a hollow core and being concentric with the inner tube for selectively engaging and radially outwardly displacing the lugs in response to a pressurized fluid applied to the hollow core of said outer tube, said assembly including first and second like coupling means at a respective different assembly end for coupling and securing together the inner and outer tubes in fluid sealing engagement at each end to form a removable integral assembly relative to the cylinder, each coupling means having a circular cylindrical axially extending bore, the bores being coaxial; and bladder assembly support means releasably secured to the sleeve in the hollow core of the sleeve comprising a pair of opposing cylindrical bladder assembly support male members each fluid sealingly received in a different bore extending axially toward one another for providing sole radial support for the assembly at said first and second coupling means and for axially securing the assembly in the sleeve core.

2. The support structure of claim 1 wherein the support means comprises a cylindrical plug closely received with substantially negligible relative radial play in the sleeve core at each sleeve end and the male members comprise like circular cylindrical pins cantilevered from a corresponding plug.

3. The support structure of claim 2 wherein each plug comprises a shaft extending axially beyond the sleeve core for providing a roll support journal, one of said plugs and corresponding male member including conduit means in fluid communication with the bladder assembly inner rigid tube core for selectively expanding the outer tube in response to pressurized fluid applied to said conduit means.

4. The support structure of claim 1 wherein the outer flexible tube is supported on the inner rigid tube, said first and second coupling means each including means for sealing the received male member and the outer tube thereto and for sealing the outer tube to the inner tube at the tube ends.

5. The support structure of claim 4 wherein each of said first and second coupling means comprises a cylindrical member coupled to the inner tube for relative axial displacement toward the ends of said tubes and an annular cap member responsive to the axial displacement of the cylindrical member for axial displacement therewith, said cap member including an annular portion overlying the outer tube end periphery, the coupling means including means responsive to the axial displacement of the cap member for radially sealing the inner tube to the outer tube and for radially sealing the outer tube to said cap member overlying portion.

6. The support structure of claim 4 wherein each of said first and second coupling means comprises a coupling member movably secured to the inner tube for relative selective axial displacement toward the ends of said tubes, an annular cap member having a first portion between the coupling member and the ends of said inner and outer tubes and a second portion over the outer tube at the outer tube end, and means responsive to the relative axial displacement of the coupling member for simultaneously radially sealing the inner tube to the outer tube, axially sealing the coupling member to the cap member and for radially sealing the outer tube to said cap member second portion.

7. The support structure of claim 6 wherein the coupling member comprises a tubular member extending in an axial direction and a first radially outwardly extending flange, said tubular member being threaded to and in the bore of said inner tube for said selective axial displacement, said cap member second portion comprising an axially extending tubular portion overlying the outer tube and the first portion comprising a radially inwardly depending second flange abutting the tubular member outwardly extending first flange and located between the first flange and the inner and outer tube ends, said tubular second portion having an annular recess overlying and facing the outer tube, the means responsive to the axial displacement of the coupling member comprising compressible means between the inner tube, the outer tube and the second radially depending flange responsive to the axial compression caused by inward axial displacement of the second flange for providing a radially outward force on said outer tube to force the outer tube into sealing engagement with said recess.

8. The support structure of claim 7 wherein the compressible means comprises a compressible flexible ring which upon axial compression radially expands and which provides sealing between the inner and outer tubes upon said compression.

9. The support structure of claim 8 including a rigid ring between the flexible ring and the cap member first portion.

10. The support structure of claim 7 wherein the tubes have a longitudinal axis, said annular recess being formed by a wall inclined relative to the longitudinal axis of the outer tube.

11. A roll bladder support structure comprising:

a hollow core cylindrical sleeve extending along a longitudinal axis and having opposing ends and a plurality of spaced radial openings therethrough in communication with the hollow core;

a plurality of lugs, each in a different opening extending through the sleeve into the core and arranged for radial displacement in the corresponding opening;

flexible means in said core for selectively engaging and radially outwardly displacing the lugs comprising an outer flexible tube radially supported on a hollow core inner rigid tube including means for fluid coupling the core of the inner hollow core tube to the core of the outer tube, said tubes having opposing ends;

means for receiving a pressurized fluid in the core of said rigid tube for radially outwardly flexing said outer tube; and sealing and clamp means including axially and radially displaceable means at each of the inner and outer tube ends for radially clamping each of the ends of the inner and outer tubes together and for radially fluid sealing the inner tube to the outer tube at their ends in response to radial displacement caused by axial displacement of the axially displaceable means.

12. The support structure of claim 11 wherein the sealing and clamp means comprises a tubular member coupled to the inner rigid tube in the inner tube core for relative axial displacement and including a radially outwardly extending annular flange coextensive with the inner and outer tubes, and a cap member including a tubular portion overlying the outer tube and an inwardly depending annular flange between the outwardly extending annular flange and inner and outer tube ends, a flexible sealing ring between the inner and outer tubes and between the outer end of the inner tube and the inwardly depending annular flange wherein axial compression of the ring in response to axial displacement of the outwardly extending annular flange radially expands the ring to seal the inner tube to the outer tube and the outer tube to the cap member tubular portion.

13. The support structure of claim 12 wherein the cap member tubular portion has an annular recess facing the outer tube such that the outer tube radially expands into the recess in response to the compression of the ring.

14. The support structure of claim 13 wherein the recess is defined by first and second walls, the first wall lying in a radial plane and the second wall lying in a plane inclined relative to the longitudinal axes of the inner and outer tubes.

15. The support structure of claim 14 wherein the tubular portion has an inner surface, said inclined wall joining said inner surface at a junction therebetween.

16. The support structure of claim 15 wherein the inclined wall extends radially inwardly and toward a next adjacent corresponding end of the outer tube.

17. The support structure of claim 13 including a rigid ring between the flexible ring and the cap member flange.

18. The support structure of claim 11 wherein the clamp means comprises an annular T-shaped cap member having a tubular portion and a depending flange portion, a clamp member having a tubular portion in axial threaded engagement with the inner tube in the core thereof and a radially outwardly extending flange coextensive with the inner and outer tubes and located axially outwardly of the cap member flange portion and coextensive therewith, first fluid sealing means between the inner tube end and the cap member flange portion and second sealing means between the cap member flange portion and the radially outwardly extending annular flange, the first sealing means being arranged to radially expand in response to axial compression by said clamp member such that the radial expansion seals the inner tube to the outer tube and the outer tube to the cap member tubular portion.

19. The support structure of claim 18 wherein the clamp means tubular member has an axial bore, the structure further including a male member in the bore for radially supporting the clamp means and including further sealing means between the clamp means and the male member to thereby seal the cores of the inner and outer tubes relative to external ambient atmosphere.

20. A roll bladder support structure comprising:

a rigid hollow core cylindrical sleeve extending along a longitudinal axis and having opposing ends and a plurality of spaced radial openings therethrough in communication with the hollow core;

a plurality of lugs, each in a different opening extending through the sleeve into the core and arranged for radial displacement in the corresponding opening;

flexible means in said core for selectively engaging and radially outwardly displacing the lugs comprising an outer flexible a tube radially supported on an inner rigid tube including means for fluid coupling the core of the inner tube to the core of the outer tube, said tubes having opposing ends;

means for receiving a pressurized fluid in the core of said rigid tube for radially outwardly flexing said outer tube; and sealing and clamp means including axially displaceable means at each of the inner and outer tube ends for radially clamping each of the ends of the inner and outer tubes together and for radially fluid sealing the inner tube to the outer tube at their ends in response to axial displacement of the axially displaceable means, the clamp means comprising:

an annular T-shaped cap member having a tubular portion and a depending flange portion, a clamp member having a tubular portion in axial threaded engagement with the inner tube in the core thereof and a radially outwardly extending flange coextensive with the inner and outer tubes and located axially outwardly of the cap member flange portion and coextensive therewith, first compressible fluid sealing means between the outer tube and the inner tube and between the inner tube end and the cap member flange portion and second flexible compressible sealing means between the cap member flange portion and the clamp member flange, the first sealing means being arranged to radially expand in response to axial compression such that the radial expansion seals the inner tube to the outer tube and the outer tube to the cap member tubular portion;

the cap member tubular portion having an annular recess facing the outer tube such that the outer tube radially expands into the recess in response to the compression of the second sealing means.

21. In a roll bladder support structure including a hollow core cylindrical sleeve extending along a longitudinal axis, the sleeve having opposing ends and a plurality of spaced openings therethrough in communication with the hollow core; a plurality of lugs, each in a different opening extending radially through the sleeve into the core and arranged for radial displacement in the corresponding opening, a bladder assembly for radially displacing the lugs comprising:

an inner hollow core rigid tube nested within and concentric with an outer flexible hollow core tube for supporting the outer tube, the outer tube for selectively engaging and radially outwardly displacing the lugs in response to a pressurized fluid applied to the core of said outer tube; and first and second like coupling means at a respective different end of the tubes for coupling and securing together the inner and outer tubes in fluid sealing engagement at each end to form a removable integral assembly relative to the cylindrical sleeve, each coupling means having a circular cylindrical axially extending bore, the bores being coaxial, each coupling means including radially expandable means responsive to axial compression for sealing the inner tube to the outer tube and means for axially compressing the expandable means.

22. In the support structure of claim 21 wherein the coupling means includes a cap having a section overlying the outer tube and a flange axially coextensive with the tubes, the expandable means including an O-ring between the inner and outer tubes and means threaded to the inner tube to axially compress the O-ring to radially expand the O-ring.

23. In the support structure of claim 22 wherein the cap section has an annular recess for receiving a portion of the outer tube, the outer tube portion deforming and engaging the recess in response to the radial expansion of the O-ring.

24. In the support structure of claim 23 wherein the recess has a wall inclined relative to the surface of the outer tube to form the recess into a wedge shape in transverse section.

25. In the support structure of claim 24 wherein the tubes are concentric about a longitudinal axis thereof, the inclination of the recess wall is such that the wall lies on a conical surface of revolution whose apex intersects the axis outside the ends of the tubes.

26. In a roll bladder support structure including an outer sleeve and an inner bladder assembly comprising an inner rigid tube and an outer flexible tube resposive to pressurized air applied to the flexible tube core, a joint for sealing the inner rigid tube to the outer flexible tube comprising:

a rigid inner tube nested within a flexible outer tube; and a coupling member secured to each of the ends of the nested tubes, the coupling member comprising:

a tubular member over the outer tube and having an annular recess therein overlying the outer tube;

a flange depending from the tubular member;

a flexible compressible and expandible ring between (1) the outer end of the inner tube and the flange and (2) between the outer end of the inner tube and the outer tube aligned radially with the annular recess; and means coupled to the inner tube for axially compressing the expandible ring to radially expand the ring against the outer tube to force the outer tube into the recess forming a seal therebetween.

* * * * *